US005266051A

United States Patent [19]

Chupak

[11] Patent Number: 5,266,051

[45] Date of Patent: Nov. 30, 1993

[54] ONE PIECE GROMMET

[75] Inventor: John M. Chupak, West Middlesex, Pa.

[73] Assignee: General Motors Corporation, Detroit, Mich.

[21] Appl. No.: 982,349

[22] Filed: Nov. 27, 1992

[51] Int. Cl.[5] ..... H01R 13/73

[52] U.S. Cl. ..... 439/559; 439/273

[58] Field of Search ..... 439/548, 556, 557, 559, 439/271-283

[56] References Cited

U.S. PATENT DOCUMENTS

| | | | |
|---|---|---|---|
| 3,941,444 | 3/1976 | Bruni et al. | 439/587 |
| 4,199,212 | 4/1980 | Balddyga | 439/587 |
| 4,588,242 | 5/1986 | McDowell | 439/271 |
| 4,909,760 | 3/1990 | OKeefe, II et al. | 439/587 |
| 5,037,326 | 8/1991 | Reedy | 439/556 |

*Primary Examiner*—David L. Pirlot

*Attorney, Agent, or Firm*—William A. Schuetz

[57] ABSTRACT

A one piece thermoplastic sealing grommet for passing a plurality of electrical conductors through a hole in a panel and for sealing off the hole through the panel. The grommet comprises a substantially rigid support plate having an integral pilot wall which passes through the hole in the panel, a seal housing within the pilot wall for sealingly engaging individual conductors passing therethrough and a deflectable, integral, non-perpendicularly extending sealing flange surrounding the pilot to provide a face seal against said panel.

6 Claims, 2 Drawing Sheets

ONE PIECE GROMMET

BACKGROUND OF THE INVENTION

This invention relates generally to a grommet assembly for a wiring harness, and more particularly, to a one piece grommet for passing a plurality of electrical conductors or the like through a hole in the panel and for sealing off the hole through the panel.

SUMMARY OF THE INVENTION

The present invention provides a one piece sealing grommet for passing a plurality of electrical conductors through a hole in a panel and for sealing off the hole through the panel. The one piece grommet is molded from a thermoplastic rubber material and comprises a substantially rigid support plate for attachment to the panel and with the support plate having an integral pilot wall which projects therefrom and is sized to pass through the opening in the panel to which the support plate is to be attached. The grommet further includes an integral seal housing which is located within the pilot wall and with the seal housing have a plurality of apertures extending therethrough. The seal housing has integral annular deflectable sealing lips extending radially inwardly from each side wall defining the apertures for slidably and sealingly engaging individual electrical conductors which are to be passed therethrough and the hole in the panel.

The one piece grommet further includes a deflectable sealing flange integral with the support plate and surrounding the pilot wall of the support plate. The deflectable flange is engageable with the panel to provide a face seal between the surface of the support plate outwardly of the pilot wall and a surface of the panel surrounding the hole when the support plate is attached to the panel. The sealing flange extends non-perpendicularly of the support plate and is of a thin cross section so that it deflects to provide a seal between the adjacent surfaces of the support plate and the panel when the grommet is attached to the panel.

The advantages of the novel grommet of the present invention are that it is of a one piece molded construction and is very inexpensive to produce as compared to multi-part grommet assemblies used previously. In addition, the grommet can be molded from a suitable thermoplastic material so that the support plate and pilot wall are substantially rigid while the deflectable flange for engaging the panel and the sealing lips for engaging the electrical conductors sufficiently flexible or deflectable to provide good seals.

The present invention further resides in various novel constructions and arrangement of parts, and further novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which:

DESCRIPTION OF THE PREFERRED EMBODIMENT

Figure 1:
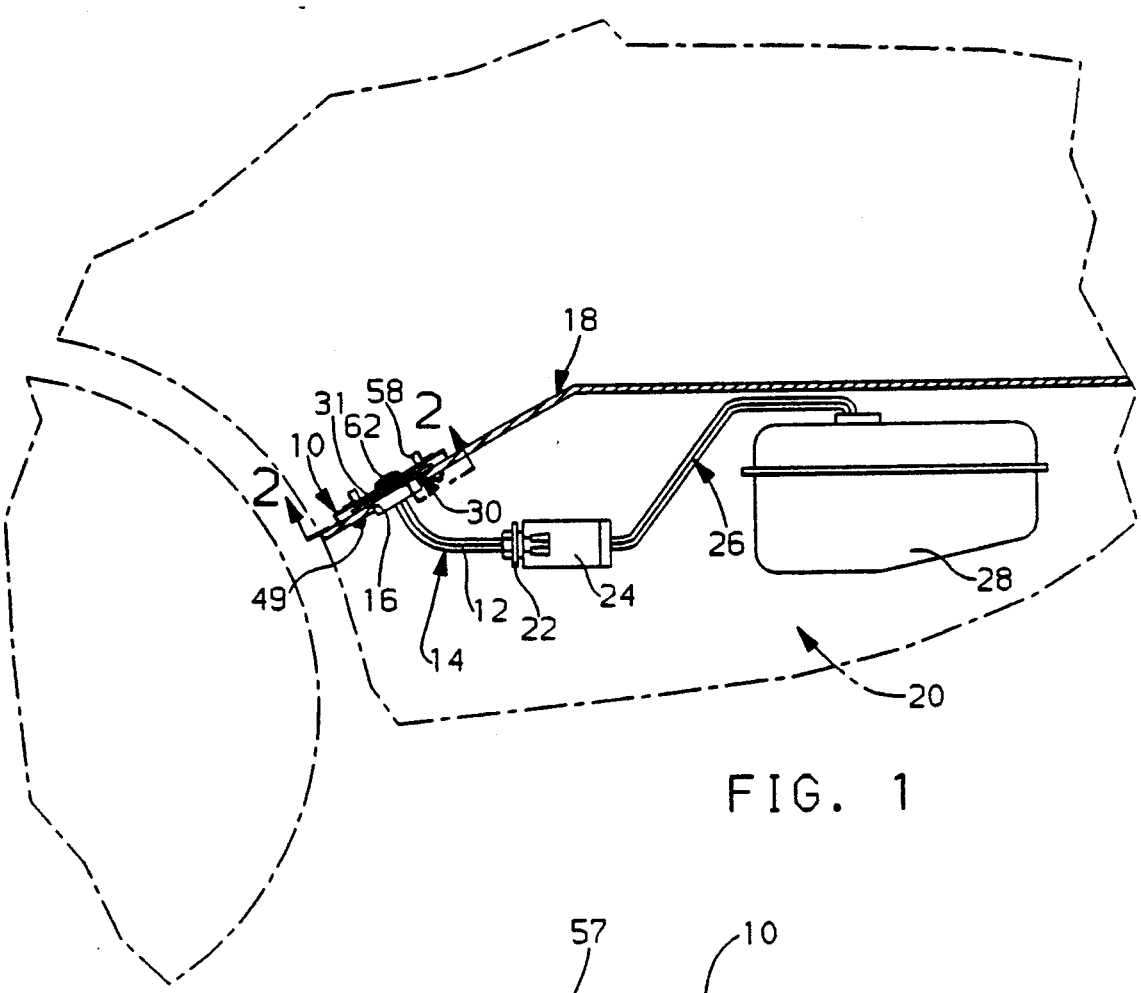
FIG. 1 is a schematic view showing a sealing grommet assembly including the one piece sealing grommet in accordance with the present invention which is attached to a floor pan an automotive vehicle.

Referring to FIG. 1 of the drawings, a sealing grommet assembly 10 for passing a plurality of electrical conductors 12 of a wiring harness 14 through a hole 16 in a panel or floor pan 18 of an automotive vehicle 20 in a sealed fashion is thereshown. The wiring harness 14 includes an electrical end connector which is connected to a mating electrical end connector 24 of a second wiring harness 26 for an electrical fuel pump (not shown) in a fuel tank 28.

The sealing grommet assembly 10 comprises a one piece thermoplastic elastomeric or rubber grommet 30 and a sheet metal cover 31. The one piece grommet 30 is molded from a suitable thermoplastic rubber material, such as that sold under the trademark Hytrel by the E. I. DuPont de Nemours Corporation.

Figure 3:
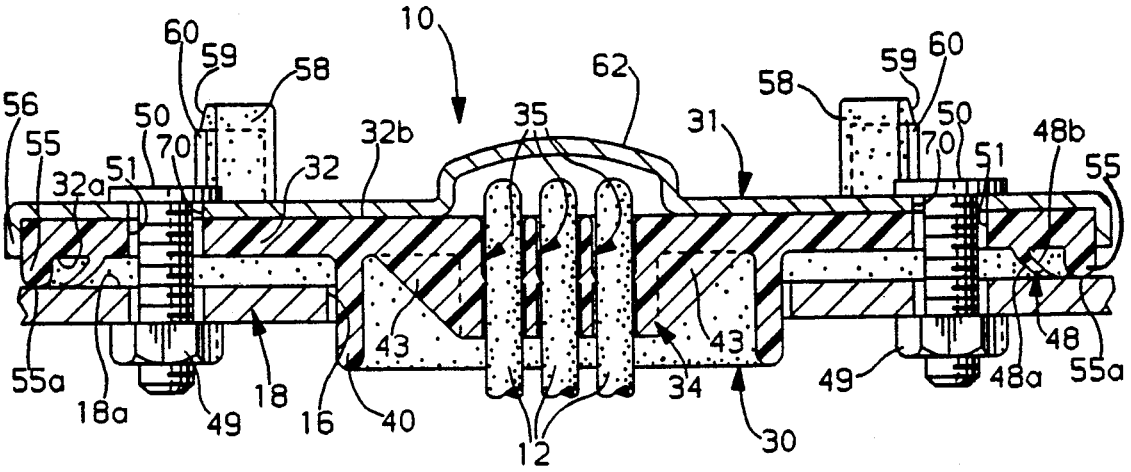
FIG. 3 is a cross sectional view of the grommet assembly taken substantially along the lines 3—3 of FIG. 2.
Figure 4:
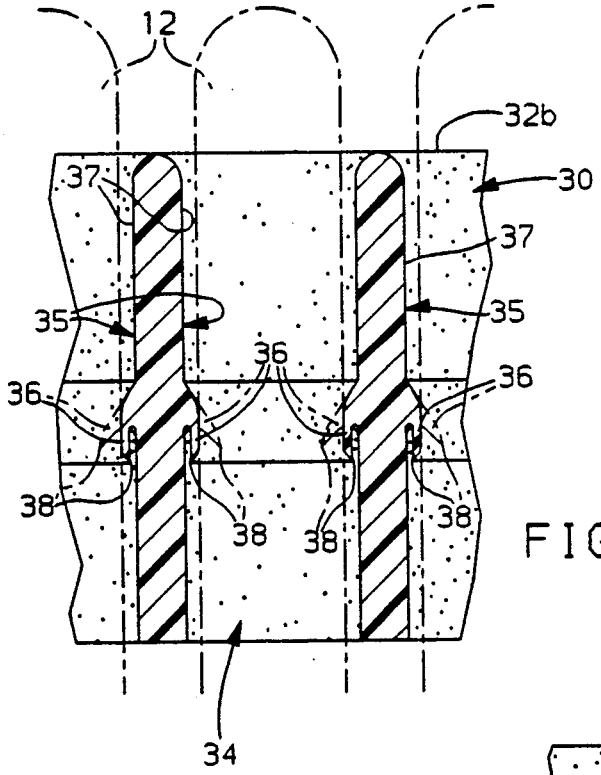
FIG. 4 is an enlarged fragmentary cross sectional view of part of the one piece grommet shown in FIG. 3.

The one piece grommet 30 has an oval or diamond shaped support plate 32 for attaching the sealing grommet assembly 10 to the panel 18 so that it covers the hole 16 and extends through the panel 18 as shown in FIG. 3. The support plate 32 has an integral, centrally located rectangularly shaped seal housing 34. The seal housing 34 extends perpendicular to the support plate 32 and has a plurality of parallel, circular through apertures 35 through which individual ones of the electrical conductors 12 are passed therethrough. The seal housing 34 includes an annular sealing lip 36 which extends radially inwardly of each side wall 37 defining each of the apertures 35. The sealing lips 36 are located intermediate or midway of the opposite ends of the apertures 35. The sealing lips 36 are tapered so as to have a thickness which progressively decreases proceeding from the side wall 37 toward their free ends 38. The annular sealing lips 36 are flexible or deflectable so that when an electrical conductor 12 is passed therethrough they will deflect and sealingly engage the outer peripheral surface of the conductors 12 to provide a seal between the grommet assembly 10 and the electrical conductors 12.

Figure 2:
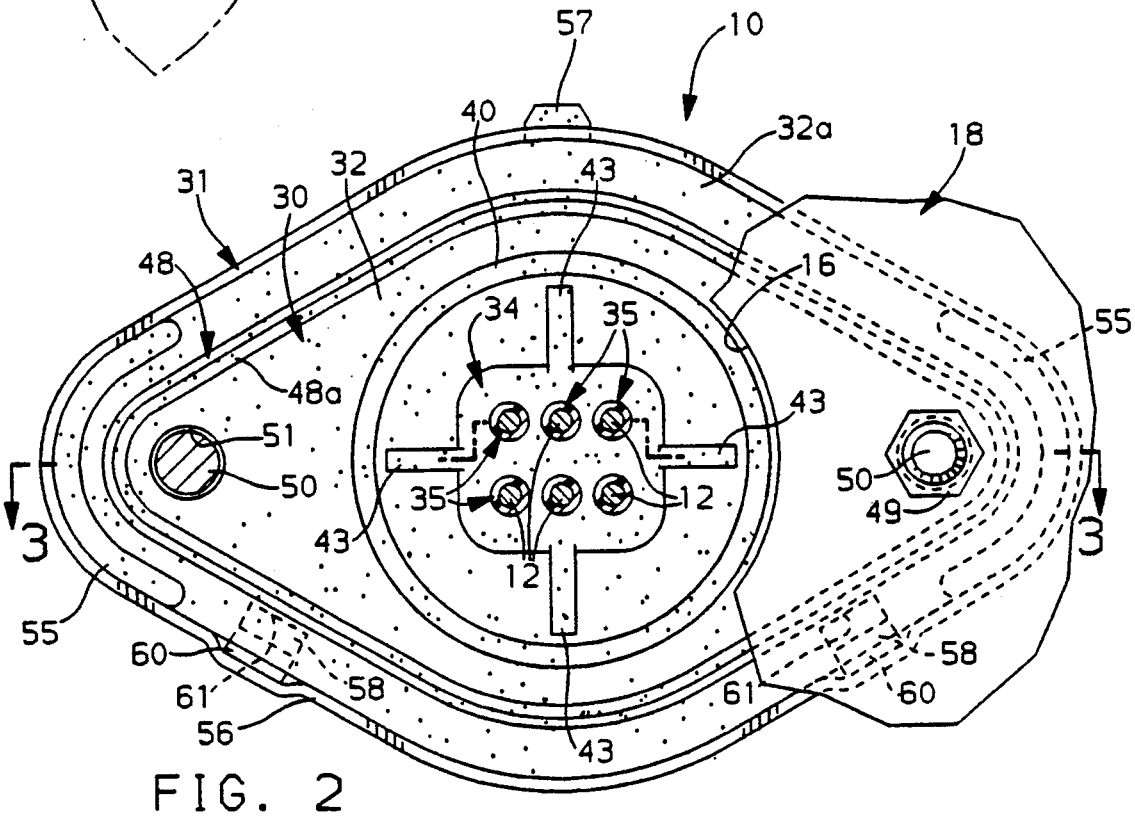
FIG. 2 is an enlarged cross sectional plan view of the grommet assembly taken substantially along the lines 2—2 of FIG. 1.

The support plate 32 also includes an integral annular pilot wall 40 which projects perpendicularly from the support plate 32 in the same direction and for a greater distance than the seal housing 34. The pilot wall 40 surrounds the seal housing 34 in a spaced relationship, as shown in FIGS. 2 and 3, and it is sized so that it passes through the hole 16 in the panel 18, as shown in FIG. 3. The seal housing 34 also includes a plurality of tapered ribs 43 extending from its outer side walls to the base of the pilot wall 40 for strengthening purposes.

The one piece grommet 30 further includes an integral, deflectable or flexible sealing flange 48. The flange 48 is oval shaped and surrounds the pilot wall 40 of the support plate 32 and is engageable with the panel 18 to provide a face seal between the surface 32*a* of the support plate 32 and the surface 18*a* of the panel around the hole 16 when the support plate 32 is attached to the panel 18 via suitable nuts 49 and bolts 50 as shown in FIG. 3. The deflectable flange 48 also surrounds a pair of through openings 51 in the support plate 32 through which the bolts 50 pass.

Figure 5:
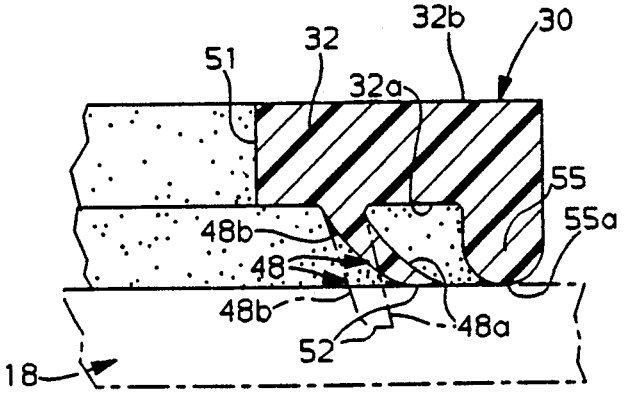
FIG. 5 is an enlarged cross sectional view of another part of the one piece grommet shown in FIG. 3.

As shown in FIGS. 3 and 5, the sealing flange 48 is continuous, of a relatively thin thickness and has inner and outer wall suraces 48*a* and 48*b*, respectively, which are substantially parallel. The sealing flange 48 is skewed, i.e., extends non-perpendicularly, with respect to the surface 32*a* of the support plate 32. The sealing flange 48 also diverges radially outwardly proceeding from the face 32*a* of the support plate 32 towards its free end 52 spaced from the support plate 32. The annular flange 48, when attached to the panel 18, deflects outwardly, as shown in FIGS. 3 and 5, to provide a good seal surrounding the opening 16 in the panel 18 and surrounding the pilot wall 40 and seal housing 34 of the support plate 32.

To prevent over deflection of the sealing flange 48, when the support plate is bolted to the panel 18, the support plate 32 includes a pair of integral stops 55 at its apices, as shown in FIGS. 2 and 3. The stops 55 are perpendicular to the surface 32*a* of the support plate 32. The stops 55 at their outer free ends 55*a* are rounded and serve to engage the support panel 16 to prevent over deflection of the flange 48.

The grommet assembly 10 preferably also includes an oval or diamond shaped sheet metal cover 31 which is mounted on the support plate at its side 32*b* opposite the side of the seal housing 34 and the pilot wall 40. The sheet metal cover 31 has a peripheral lip 56 which fits around the periphery of the support plate 32, as best shown in FIG. 2, and is retained on the support plate 32 by a tab 57 and plastic lock arms 58 of the support plate 32. The tab 57 and lock arms 58 are integral with the support plate 32 and the arms 58 extend perpendicular to the side 32*b* thereof and have a barb 59 at their free ends. The tab 57 fits through a slot (not shown) in the peripheral lip 56 of the cover 31 and the lock arms 58 extend through slots 61 in the sheet metal cover 31 and snap fit over bent up ears 60 on the sheet metal cover 31. The sheet metal cover 31 also includes a channel portion 62 which covers the central portion of the support plate 32 surrounding the seal housing and extends to an edge of a sheet metal cover 31 which is between the stops 55. The channel portion 62 directs the electrical conductor 12 extending through the seal housing 34 at a right angle and parallel to the upper side 32*b* of the support plate 32.

The electrical conductors 12 are preferably preassembled to the grommet support plate 32 and then bent to lie flush with the side 32*b* thereof. Thereafter the cover 31 can be snap fittingly connected to the support plate 32 to form the grommet assembly 10. This unit can then be shipped as a wiring harness and located on the vehicle by the grommet assembly being bolted to the floor pan 18 by the bolts 50 and nuts 49, the cover 31 having openings 70 which are aligned with the openings 51 in the support plate 32 through to enable the bolts 50 to pass therethrough.

From the foregoing, it should be apparent that a novel one piece, molded sealing grommet for a wiring harness has been provided. The grommet is inexpensive and readily moldable from a suitable thermoplastic rubber material.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. A one piece sealing grommet for passing a plurality of electrical conductors or the like through a hole in a panel and for sealing off said hole in said panel when attached to the panel, said grommet being molded from a thermoplastic material and comprising:

a support plate for attachment to said panel, said support plate having an integral pilot wall which projects from the support plate and is sized to pass through said hole in said panel to which the support plate is to be attached, a seal housing integral with said support plate and located within said pilot wall, said seal housing having a plurality of apertures extending therethrough, said seal housing having integral annular deflectable sealing lips extending radially inwardly of each side wall defining said apertures therein which slidably and sealingly engage individual electrical conductors which are to be passed through said hole in said panel, a deflectable flange integral with said support plate and surrounding said pilot wall of said support plate and engageable with said panel to provide a face seal between a surface of the support plate outwardly of the pilot wall and a surface of the panel surrounding the hole when the support plate is attached to the panel, said flange extending transversely of said surface of said support plate and being of a thin cross section so that it deflects to provide a seal between said surface of said support plate and said surface of said panel when being attached to said panel, and wherein said support plate has transversely extending stops which are of a height less than the height of said flange for engaging said panel to limit deflection of said flange when said support plate is being attached to said panel.

2. A one piece sealing grommet, as defined in claim 1, and wherein said flange has inner and outer substantially parallel wall surfaces and with the flange diverging outwardly from said face of said support plate to its free end spaced from said support plate.

3. A one piece sealing grommet for passing a plurality of electrical conductors of a wring harness through a hole in a panel and for sealing off said hole in said panel when attached to the panel, said grommet being molded from a thermoplastic rubber material and comprising:

a support plate for attachment to said panel, said support plate having an integral pilot wall which projects from the support plate and is sized to pass through said hole in said panel to which the support plate is to be attached, a seal housing integral with said support plate and located within said pilot wall, said seal housing having a plurality of apertures extending therethrough, said seal housing having integral annular deflectable sealing lips extending radially inwardly of each side wall defining said apertures therein which slidably and sealingly engage individual electrical conductors which are to be passed through said hole in said panel, a deflectable flange integral with said support plate and surrounding said pilot wall of said support plate and engageable with said panel to provide a face seal between a surface of the support plate outwardly of the pilot wall and a surface of the panel surrounding the hole when the support plate is attached to the panel, said flange extending non-perpendicularly of said surface of said support plate and being of a thin cross section so that it deflects to provide a seal between said surface of said support plate and said surface of said panel when being attached to said panel, and wherein said support plate has a plurality of integral, perpendicularly extending stops located outwardly of said flange and which are of a height less than the height of said flange, said stops engaging said panel to limit deflection of said flange when the support plate is attached to said panel.

4. A wiring harness having a plurality of electrical conductors, one piece sealing grommet for passing said plurality of electrical conductors through a hole in a panel and for sealing off said hole in said panel when attached to the panel, said grommet being molded from a thermoplastic rubber material and comprising:

a support plate for attachment to said panel, said support plate having an integral pilot wall which projects from the support plate and is sized to pass through said hole in said panel to which the support plate is to be attached, a seal housing integral with said support plate and located within said pilot wall, said seal housing having a plurality of apertures extending therethrough, said seal housing having integral annular deflectable sealing lips extending radially inwardly of each side wall defining said apertures therein which slidably and sealingly engage individual electrical conductors of said wiring harness which are to be passed through said hole in said panel, a deflectable flange integral with said support plate and surrounding said pilot wall of said support plate and engageable with said panel to provide a face seal between a surface of the support plate outwardly of the pilot wall and a surface of the panel surrounding the hole when the support plate is attached to the panel, said flange extending non-perpendicularly of said surface of said support plate and being of a thin cross section, said flange having inner and outer substantially parallel wall surfaces and progressively diverging outwardly from said face of said support plate to its free end spaced from said support plate so that it deflects outwardly to provide a seal between said surface of said support plate and said surface of said panel when being attached to said panel, and wherein said support plate has a plurality of integral, perpendicularly extending stops located outwardly of said flange and which are of a height less than the height of said flange, said stops engaging said panel to limit the outward deflection of said flange when the support plate is being attached to said panel.

5. A wiring harness, as defined in claim 4, and a metal cover which is attached to said support plate on its side opposite said pilot wall.

6. A wiring harness, as defined in claim 4, and wherein the cover has a channel portion which covers said seal housing and which extends to an edge of the cover to direct the electrical conductors extending through the seal housing in a direction generally parallel to the support plate.

* * * * *